US005401078A

United States Patent [19]

Riach

[11] Patent Number: 5,401,078

[45] Date of Patent: Mar. 28, 1995

[54] ADJUSTABLE THERAPY CHAIR

[75] Inventor: Linda A. Riach, Parkton, Md.

[73] Assignee: Oakworks, Inc., Glen Rock, Pa.

[21] Appl. No.: 893,320

[22] Filed: Jun. 3, 1992

[51] Int. Cl.[6] ..... A47C 7/50; A47C 4/00

[52] U.S. Cl. ..... 297/423.11; 297/19; 297/195.11; 297/215.13

[58] Field of Search ..... 297/411, 416, 423, 464, 297/195, 391, 392, 408, 19, 25, 16, 25, 411.2, 411.38, 423.1, 423.11, 423.12, 423.39, 195.1, 195.11, 215.13, 46, 56, 58

[56] References Cited

U.S. PATENT DOCUMENTS

| | | | |
|---|---|---|---|
| 224,319 | 2/1880 | Allen | 297/25 |
| 435,656 | 9/1890 | Shaw et al. | 297/25 |
| 1,025,422 | 5/1912 | Peters | 297/423 |
| 1,721,221 | 7/1929 | Jauregui | 297/411 |
| 2,181,465 | 11/1939 | Schneider | 155/158 |
| 2,417,439 | 3/1947 | Overdick | 297/25 |
| 3,425,743 | 2/1969 | Peterson | 297/19 |
| 3,594,037 | 7/1971 | Sherman | 297/14 |
| 3,754,787 | 8/1973 | Garber | 297/195 |
| 3,759,539 | 9/1973 | Goldberg | 297/16 |
| 4,207,879 | 6/1980 | Safadago | 128/70 |
| 4,215,680 | 8/1980 | Okuda | 128/33 |
| 4,354,485 | 10/1982 | Safadago | 128/70 |
| 4,453,768 | 6/1984 | Cranford, Jr. et al. | 297/440 |
| 4,589,699 | 5/1986 | Dungan | 297/423 |
| 4,614,378 | 9/1986 | Picou | 297/423 |
| 4,650,249 | 3/1987 | Serber | 297/313 |
| 4,662,361 | 5/1987 | Patterson | 128/25 R |
| 4,685,730 | 8/1987 | Linguanotto | 297/316 |
| 4,746,167 | 5/1988 | Palmer et al. | 297/423 |
| 4,830,429 | 5/1989 | Petitjean | 297/284 |
| 4,913,487 | 4/1990 | Breckel et al. | 297/14 |
| 4,943,117 | 7/1990 | Brown | 297/423 |
| 4,971,040 | 11/1990 | Gillotti | 123/24 R |
| 5,018,790 | 5/1991 | Jay | 297/458 |
| 5,177,823 | 1/1993 | Riach | 297/408 |

FOREIGN PATENT DOCUMENTS 3630634 3/1988 Germany .

OTHER PUBLICATIONS

The High-Touch Massage Chair, Living Earth Crafts, 600 East Todd Road, Santa Rosa, California 95407.

The Dolphin Massage Chair, Pisces Productions, P.O. Box 208, Cotati, California 94931.

On-Site Chair, Stronglite, 80926 Turkey Run Road, Creswell, Oregon 97426.

Quick/Lite On-Site Chair, Golden Ratio Woodworks, Highway 89, Seven Point Ranch, Emigrant, Montana 59027.

The Body Chair, Touch America, P.O. Box 1304, Hillsborough, North Carolina 1304.

*Primary Examiner*—Clifford D. Crowder
*Assistant Examiner*—Amy B. Vanatta
*Attorney, Agent, or Firm*—Leonard Bloom

[57] ABSTRACT

A unitary, portable, foldable and adjustable therapy chair on which a patient is seated. The chair includes a frame having two pivotal members which move in a scissor-like manner. Attached to the frame are a seat, a chest support, an arm support, a face support and a pair of leg supports. The chair is adjustable from a collapsed position to a plurality of erect positions. The frame may be secured in a desired use position. When the chair is adjusted, the seat, the chest support, the arm support and the leg supports move with respect to one another.

31 Claims, 6 Drawing Sheets

ADJUSTABLE THERAPY CHAIR

FIELD OF THE INVENTION

The present invention relates to chairs used for seating patients to facilitate treatment by therapists and the like and more particularly to a foldable and adjustable chair.

BACKGROUND OF THE INVENTION

Persons having physical ailments which require therapy and/or treatment on a regular basis are becoming more aware of the availability of therapists, chiropractors and the like who make visits to the person's office or home to provide the treatment. This enables busy executives to use their time more efficiently in the office and provides an option for persons who have difficulty in traveling from their homes. Also, due to the stresses of the present business world, there is an increased interest and need for persons to receive massages to relax and stimulate their bodies. In order to provide these services, the therapist making the office or home visit needs a portable chair on which to seat the patient to permit the therapy to be provided in an efficient manner. This chair should be adjustable to be capable of seating patients of differing sizes and heights and also to enable the therapist to more effectively treat the patient by providing the therapist with improved access to the patient. A further need for such a chair is in the office of the therapist, chiropractor or the like where space is a factor and the availability of a lightweight, foldable chair for a patient can significantly save valuable space as compared to a therapy table or a non-foldable chair.

The existing portable message chairs are comparatively heavy and have more limited adjustability. U.S. Pat. No. 4,746,167 issued to Palmer et al discloses a wooden chair which includes a case with a lid and which contains a seat member, a leg rest, an arm rest, a chest support, a face cradle and a brace assembly, all individual components which are assembled to form the chair. U.S. Pat. No. 4,071,040 issued to Gillotti discloses a wooden body member with a chest cushion, a face cushion, a pair of arm cushions and a leg portion pivotably connected to the body member.

Safadago et al, U.S. Pat. No. 4,207,879 discloses a prone board which can be converted to a chair. In U.S. Pat. No. 4,354,485 Safadago discloses an alternate embodiment of a prone board for therapeutic usage. U.S. Pat. No 4,453,768 issued to Cranford, Jr. et al discloses a portable reclining examination chair including a container in which the components may be stored for transportation. U.S. Pat. No. 4,662,361 issued to Patterson discloses a physical therapy chair which has an elongated, rigid base. A seat portion is disposed above the rear end of the base. Arm, chest and head rests are disposed on a support over the front end of the base. An ergonomic seating assembly is disclosed in U.S. Pat. No. 4,650,249 issued to Serber. The assembly includes a pelvic tilt seat which is mounted on an upright post. The assembly is not foldable and is configured for unimpeded movement of the arms.

Additional prior art patents known to the applicant and which are pertinent to foldable chairs and sit-kneel chairs are the following:

| Inventor | U.S. Pat. No. |
|---|---|
| Schneider | 2,181,465 |
| Sherman | 3,594,037 |
| Okuda | 4,215,680 |
| Dungan | 4,589,699 |
| Linguanotto | 4,685,730 |
| Pettijean | 4,830,429 |
| Breckel, et al | 4,913,487 |

Thus, there exists a need for a lightweight, portable and adjustable chair on which a patient can be seated to facilitate treatment by a therapist.

SUMMARY OF THE INVENTION

Accordingly, it is a primary object of the present invention to alleviate the disadvantages and shortcomings of the prior art by providing a lightweight, foldable, portable and adjustable chair on which a patient may be seated while being treated by a therapist, chiropractor or the like.

It is another object of the present invention to provide a chair having a frame which is adjustable and can be secured in a desired use position and when so adjusted, the seat, the chest supports, the arm support and the leg supports move with respect to one another to accommodate the posture and size of the patient seated on the chair.

It is yet another object of the present invention to provide a chair wherein the chest support is adjustable from a more vertical position to a position which is more horizontal and is angularly displaced at least 20° from the more vertical position and in which the height of the chest support may be moved approximately five to six inches in the vertical plane.

It is still another object of the present invention to provide a chair wherein the seat is pivotably movable from a substantially horizontal position to a position which is at an angle to the horizontal when the chair is adjusted to accommodate the patient and to facilitate treatment by the therapist.

It is a further object of the present invention to provide a portable, foldable, adjustable chair which has an arm support which is attached to the back of the frame of the chair and which may be adjusted horizontally with respect to the frame of the chair.

It is still further object of the present invention to provide a portable, foldable, adjustable chair which can be adjusted to a plurality of erected positions for seating the patient and to a collapsed position for storage and transport.

In accordance with the broad teachings of the present invention, there is herein illustrated and described a portable, foldable and adjustable therapy chair on which a patient is seated to facilitate treatment by a therapist or the like. The chair includes a tubular frame having a front, a back, a first side and a second side. Each side further includes a first member having a top, a bottom and an intermediate portion therebetween, and a second member having a top, a bottom and an intermediate portion there between. The intermediate portions of the respective members are pivotably connected such that the members may move in a scissors-like manner with respect to one another. The bottoms of the second members of each side are connected by a first cross member and the bottoms of the first members on each side are connected by a second cross member. The first cross member and the second cross member are disposed on a horizontal surface when the patient is seated on the chair. The tops of the first members are connected by a third cross member. A seat is provided which has a first edge and an opposite second edge, the first edge being pivotably connected between the top ends of the second members of the frame, the second edge of the seat being pivotably connected to a first end of a post. The post has a second end connected to a midpoint of the second cross member, thereby pivotably connecting the tops of the second members to the bottoms of the first members, the post has a plurality of spaced apart fastening means formed thereon. A cable having a first end is connected to a midpoint of the first cross member. The cable extends beyond the second cross member. A second end of the cable has means thereon to removable engage at least one of the fastening means on the post such that when the second end of the cable and the fastening means on the post are engaged, the frame is secured in a desired use position. When the second end of the cable and the fastening means on the end of the post are disengaged, the frame may be adjusted between a fully erected and a fully collapsed position.

A chest support is connected to the frame, an arm support is connected to the frame, two leg supports are connected to the frame and a face support is connected to the tops of the first members of the frame. When the frame is pivotably moved, both sides of the frame move concomitantly. The seat, the chest support, the arm support and the leg supports move with respect to one another to accommodate the posture and size of the patient seated on the chair and the frame is adjustable to a plurality of erected positions for seating the patient and to the collapsed position for storage and transport.

In a preferred embodiment, the tops of the second members are connected by a fourth cross member. A seat is provided which has an upper surface, a first edge and an opposite second edge. Said first edge is pivotably mounted to the fourth cross member, said second edge is pivotably connected to a first end of a post. The post has a second end connected to a midpoint of the second cross member, whereby, when the chair is adjusted to seat the patient, the contact surface of the seat is movable from a horizontal plane substantially parallel to the surface on which the chair is disposed to a plane which is angled downwardly toward the back of the frame whereby the seat is adjusted for the comfort of the patient seated in the chair and whereby the seat is disposed adjacent to the frame when the chair is in the collapsed position.

In a further preferred embodiment, the arm support is substantially C-shaped having a center and two arms, each arm being pivotably connected to the respective first member of each respective side, near the tops thereof. Means are provided for controlling pivotal movement between the arm support and the sides of the frame and means are provided for securing the arm support in a desired position extending outwardly from the back of the frame. In this manner, the arm support may be adjusted for the comfort of the patient seated in the chair when the chair is erect and further, the arm support may be folded to a position adjacent to the respective first members of the sides of the frame when the chair is in the collapsed position.

In yet another preferred embodiment, the leg supports each have a front end oriented toward the front of the chair and a back end oriented toward the back of the chair. The front ends of the respective leg supports are connected by a first connecting member. The first connecting member movably rests on the intermediate portion of the first member of the frame. The back ends of the respective leg supports are connected by a second connecting member. The second connecting member is secured to the intermediate portion of the second member of the frame. In this manner, when the frame is moved in a scissor-like manner, the first connecting member slides along the intermediate portion of the first member of the frame and the leg supports move concomitantly to accommodate the patient seated on the chair.

These and other objects of the present invention will become apparent from a reading of the following specifications, taken in conjunction with the enclosed drawings.

DESCRIPTION OF THE PREFERRED EMBODIMENT

Figure 1:
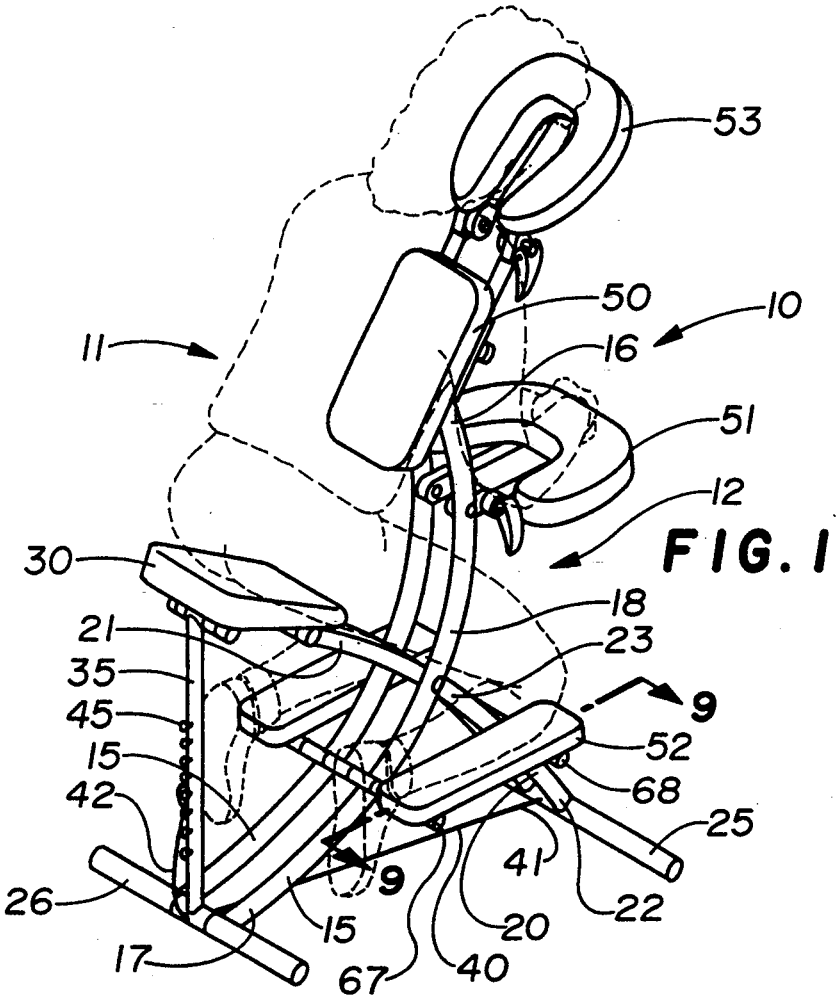
FIG. 1 is a perspective view of the chair of the present invention showing a person, in phantom lines, seated on the chair.
Figure 2:
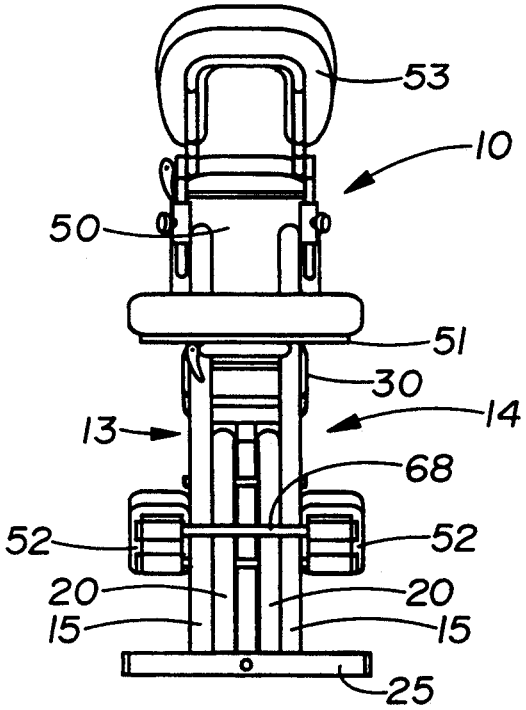
FIG. 2 is a back view of the chair of FIG. 1.
Figure 3:
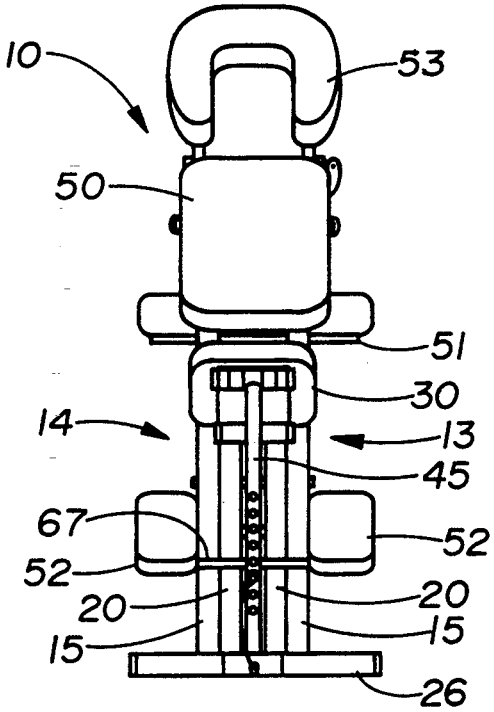
FIG. 3 is a front view of the chair of FIG. 1.

Referring to the figures, there is illustrated the portable, foldable and adjustable therapy chair 10 of the present invention. The patient is seated in the chair 10 facing toward the back of the chair 10 with the patient's chest on the chair so that the patient's upper back, lower back, shoulders and back of the neck are available for treatment by the therapist or the like.

The chair 10 has a frame which has a front 11, a back 12, a first side 13 and a second side 14. Each side 13, 14 is formed from a first member 15 which has a top 16, a bottom 17 and an intermediate portion 18 between the top 16 and the bottom 17 and a second member 20 which has a top 21, a bottom 22 and an intermediate portion 23 between the top 21 and the bottom 22 on each side 13,14, the intermediate portions 18,23 of the respective first member 15 and of the respective second member 20 are pivotably connected. In an alternate view, the first members 15 may be viewed as a pair of spaced-apart arms forming a first member 15 and similarly, the second members 20 may be viewed as a pair of spaced-apart arms forming a second member 20. In this manner, the members 15,20 may move in a scissors-like manner with respect to one another. The chair 10, thus may be folded between a collapsed position and a plurality of erect positions as will be described.

It is preferred that the first members 15 and the second members 20, be arcuate. The first members 15 are formed concave with respect to the horizontal surface on which the chair 10 is disposed and the second members 20 are formed convex with respect to the horizontal surface on which the chair 10 is disposed. The length of the first member 15 is greater than the length of the second member 20. The members 15,20 are preferably tubular in form to reduce the weight of the chair 10.

The bottoms 22 of the second members 20 of each side 13,14 are connected by a first cross member 25 and the bottoms 17 of the first members 15 of each side 13,14 are connected by a second cross member 26. When the chair 10 is in an erected position, and the patient is seated in the chair, the cross members 25,26 are disposed on a longitudinal surface such as the floor of the room in which the treatment is being provided. It is preferred that the first cross member 25 and the second cross member 26 extend outwardly from the connection with the bottoms 22 of the second members 20 and the bottoms 17 of the first members 15 respectively, to provide increased lateral stability to the chair 10 when the patient is seated on the chair 10.

The tops 16 of the first members 15 on each side 13,14 are connected by a third cross member 27. The tops of the second members 20 are connected by a fourth cross member 28. In this manner, the complete frame is formed; and when the frame is pivotably adjusted, both sides 13,14 of the frame move concomitantly. The frame is incrementally adjustable to a plurality of erected positions for seating the patient and to a collapsed position for storage and transport as is described below.

The tops 21 of the second members 20 of each side are pivotably connected to a seat 30. The seat 30 has a first edge 31, an opposite second edge 32 and an upper surface 33. The first edge 31 is pivotably connected to the tops 21 of the second members 20 of the respective sides 13,14. Preferably, the first edge 31 of the seat 30 has an opening therein in which the fourth cross member 28 is received in a manner so that the seat 30 may be pivotably moved about the fourth cross member 28 with respect to the tops 21 of the second members 20 on each side 13,14 of the frame. The second edge 32 of the seat 30 is pivotably connected to a post 35 at the first end 36 of the post 35. Preferably, the first end 36 of the post is T-shaped 38, and the second edge of the seat 32 has semi-circular bands 39 to receive the cross member of the T-shape 38. However, other pivotable structures may be used. The second, opposite end 37 of the post 35 is connected to the second cross member 26 at approximately the midpoint of said cross member 26. It is preferred that the second end 37 of the post 35 be pivotably connected to the second cross member 26.

Figure 5:
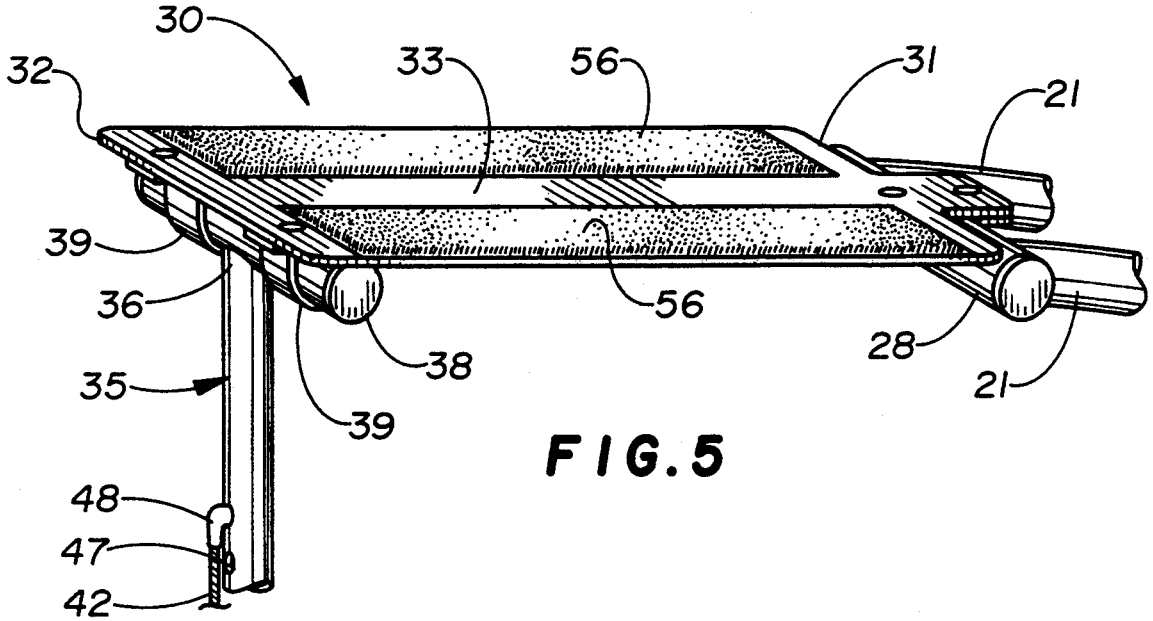
FIG. 5 is a perspective view of the seat of the chair showing the connection between the seat and the frame of the chair.
Figure 7:
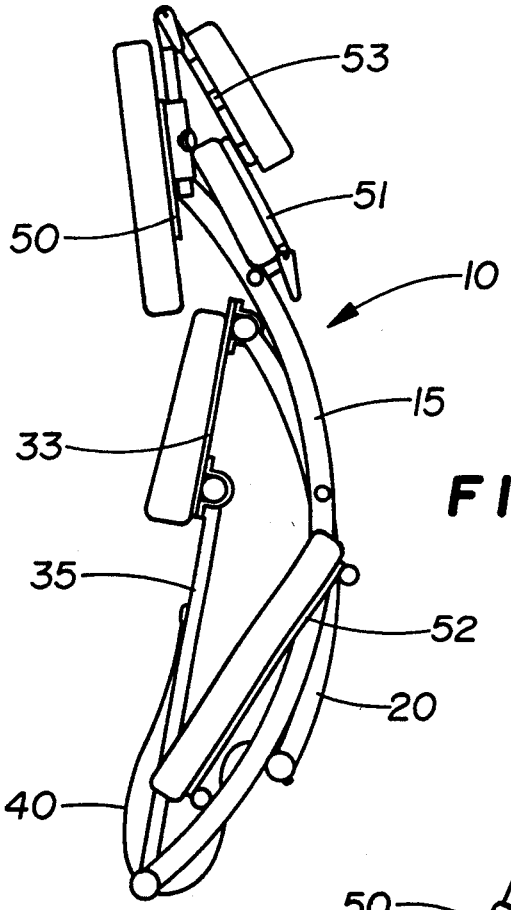
FIG. 7 is a side view showing the chair of the present invention in the collapsed position.

When the chair 10 is erected and adjusted to seat the patient, the chair 10 may be disposed in a plurality of erected positions from a most erect position to a least erect position. In the most erect position, the upper surface 33 of the seat 30 is in a horizontal plane which is substantially parallel to the surface on which the chair 10 is disposed (i.e. the floor). In the least erect position, the upper surface 33 of the seat 30 is disposed in a plane which is angled downwardly from the front 11 toward the back 12 of the frame (FIGS. 5A–5B). The maximum angle of the plane is at least 45° with respect to the horizontal plane. When the chair 10 is adjusted from the most erect to the least erect position, the first edge 31 of the seat 30 is displaced through a vertical distance of approximately five to six inches. Thus, the seat 30 is incrementally adjustable to a plurality of angles. In this manner, the seat 30 and the chair 10 may be adjusted to comfortably seat a patient having a broad range of postures, sizes and heights. Further, the pivotal arrangement permits the chair 10 to be disposed in a collapsed position wherein the seat 30 is adjacent, and substantially parallel, to the first members 15 of the sides 13,14 of the chair 10 (FIG. 7).

Figure 4:
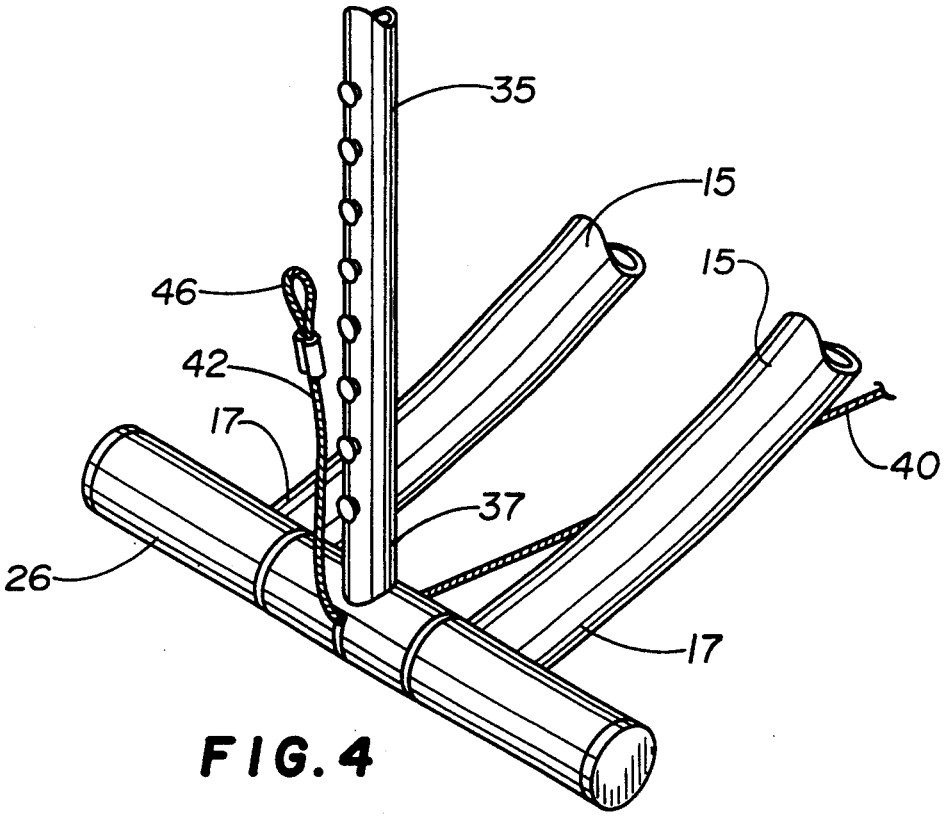
FIG. 4 is a perspective view showing the end of the cable and the fastening means on the rod.
Figure 6B:
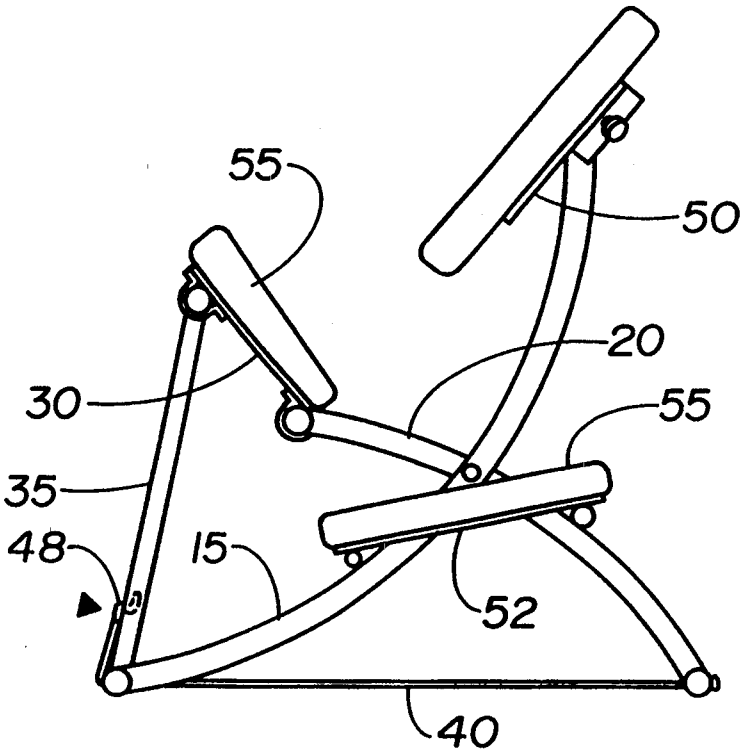
FIGS. 6A–6B are partial perspective views of the chair of the present invention showing the disposition of the seat, the chest support and the leg supports in erected positions of the chair.
Figure 6A:
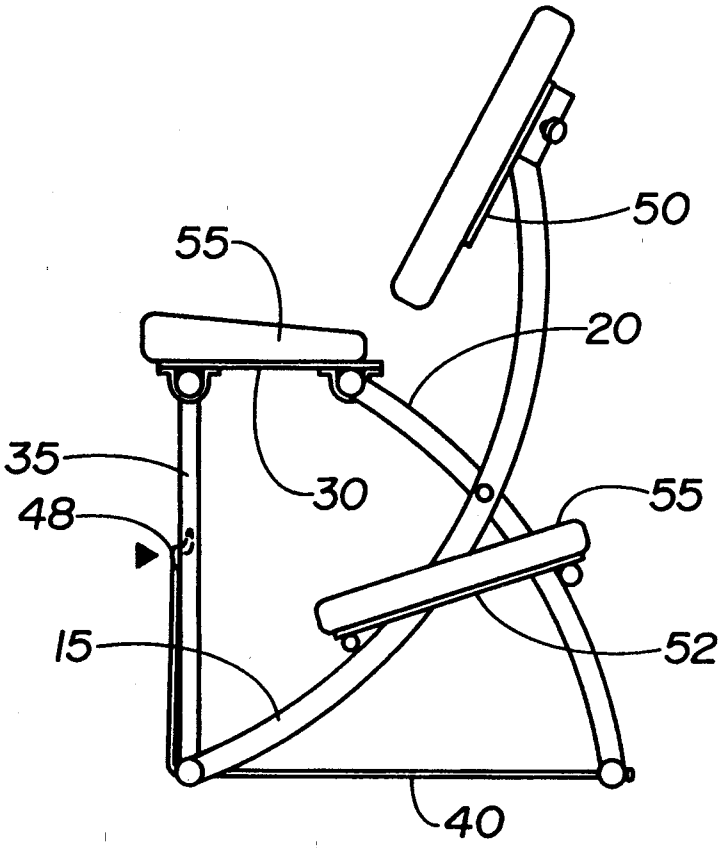

To secure the chair 10 in a desired erected position, means are provided to releasably connect the front 11 of the frame to the back 12 of the frame. In a preferred embodiment, a cable 40 has a first end 41 connected to the bottoms 22 of the second members 20, preferably to the first cross member 25 therebetween. The opposite, second end 42 of the cable 40 extends toward the first cross member 25 between the bottoms 17 of the first members 15, beyond the second cross member 26 therebetween. In a preferred embodiment, an opening 43 is formed in either the midpoint of the second cross piece 26 or in the post 35 near the second end 37 of the post 35. The opening may be at an upward angle from the back to the front to avoid twisting or kinking of the cable 40. The cable 40 passes through the opening 43 and extends outwardly, forward from the frame of the chair 10. FIGS. 4, 6A, 6B). Means known to persons skilled in the art are provided to secure the cable to the front of the frame. In a preferred embodiment, fastening means are formed on the post 35. These may be a plurality of spaced apart knobby protrusions formed on the post 35 between the first and 36 and the second end 37 of the post. A loop 46 or other engaging means may be formed on the second end 42 of the cable 40. The loop 46 in the cable 40 may engage at least one of the knobby protrusions 45 to secure the frame in a desired position. Engagement between the cable 40 with a knobby protrusion 45 nearer to the first end 36 of the post 35 (near the seat 30) results in the chair 10 being in a more erect position and engagement between the cable 40 and a knobby protrusion nearer the second end 37 of the post (near the second cross piece 26) results in the chair 10 being in a less erect position. The fastening means may be a plurality of spaced-apart openings 47 in the post 35 and a hook means 48 on the second end 42 of the cable 40. The hook means 48 may be releasably engaged in any desired opening 47 (as indicated by arrow-head in FIGS. 6A–6B). When the cable 40 is not engaged with a fastening means, such as the knobby protrusion 45 or the opening 47, the chair may be folded to the collapsed position. As known to persons skilled in the art, other fastening means may be used to engage the end of the cable 40 to the post 35. Also, the cable 40 may be formed of metal, fabric, rope or other materials and may be a rigid member having a plurality of fastening means to connect the first cross member 25 to the second cross member 26. Also, any connector which permits the incremental movement of the front of the frame toward the back of the frame may be used. The use of the cable 40 and the fastening means described above is an example of a simple, relatively inexpensive embodiment which provides a light weight connector which is easily and rapidly used and facilitates folding of the chair 10 for portability.

Figure 8:
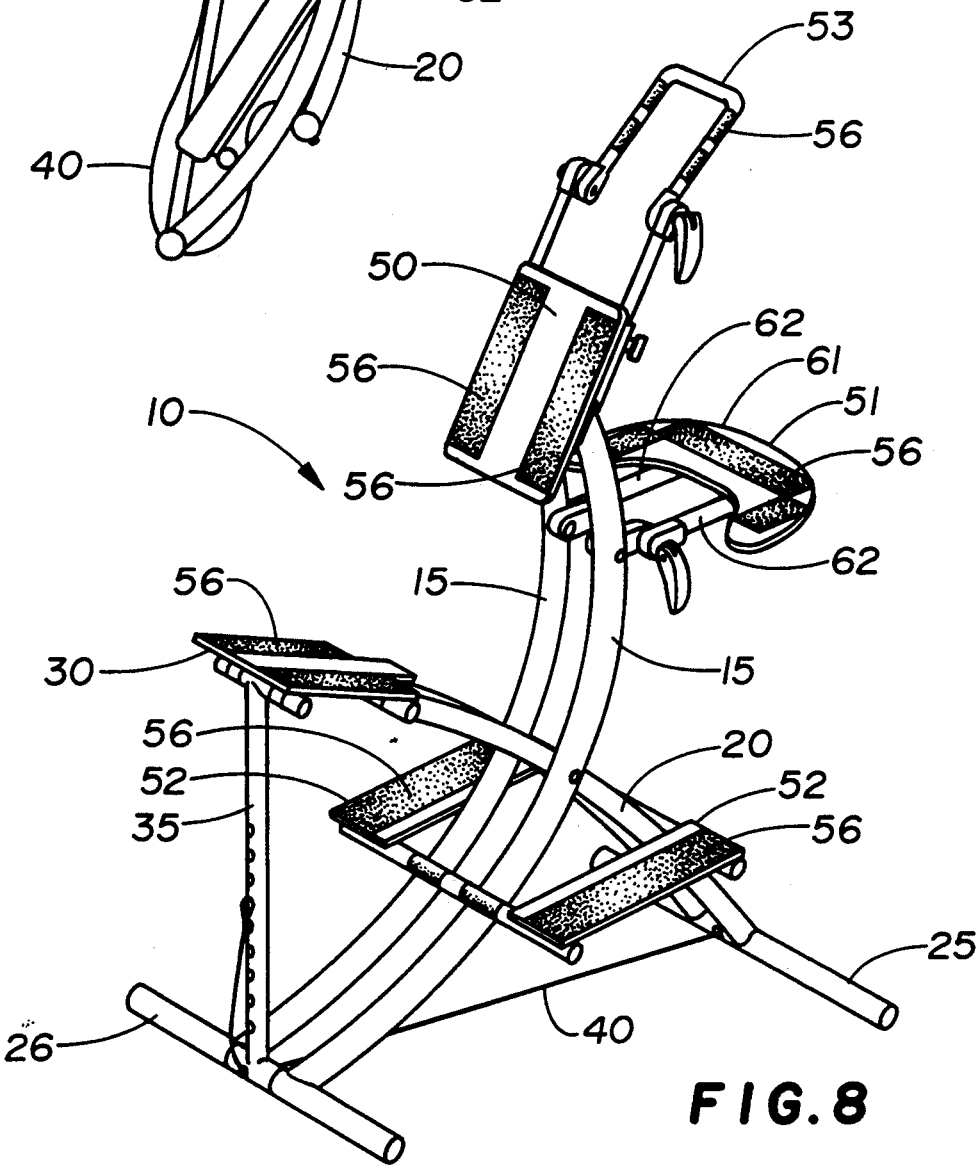
FIG. 8 is a perspective view of the chair of the present invention with the padded cushions removed therefrom.
Figure 9:
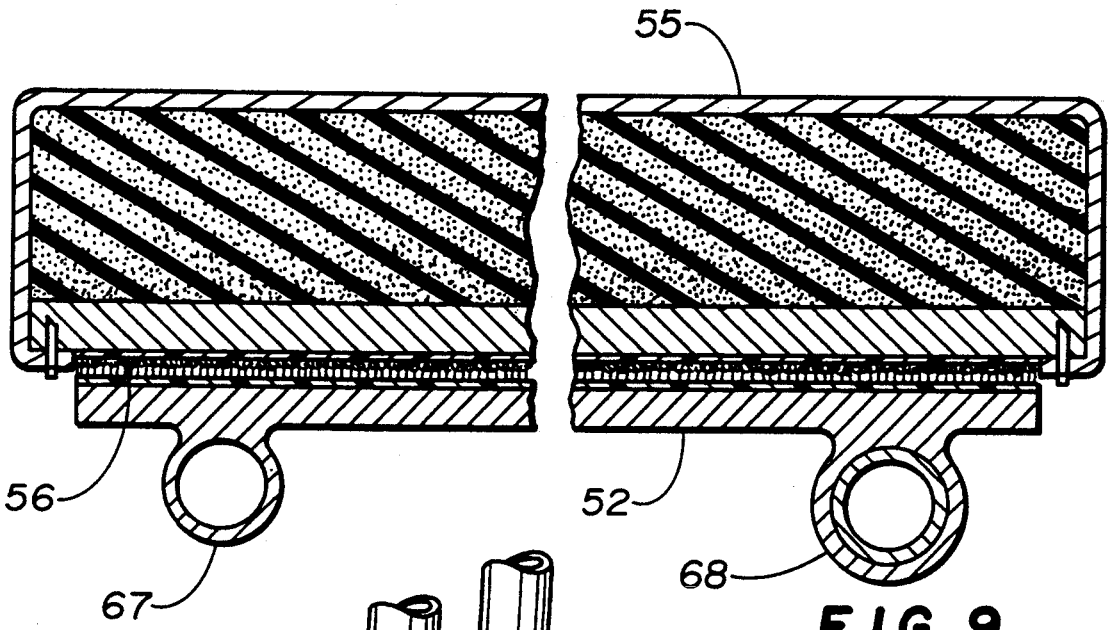
FIG. 9 is a cross sectional view taken across the lines 9—9 of FIG. 1.

A chest support 50, an arm support 51, a pair of leg supports 52 and a face support 53 are also connected to the frame as described below. Padded cushions 55 are removably attached to the seat 30 and the above supports. The chair 10 with the cushions removed is shown in FIG. 8. The padded cushions are, in a preferred embodiment, attached to the supports by hook and loop fasteners 56 for ease of attachment and removal. (FIG. 9) In addition, the simple attachment means permits rapid movement of the padded cushions to a desired position on the respective support to accommodate each individual patient.

The padded cushion 55 attached to the seat 30 may further be adjusted to better accommodate the patient by insertion of a spacer 57 between the seat 30 and the cushion. Preferably, the spacer 57 is wedge-shaped so that the padded cushion may be adjusted to a range of positions depending upon the placement of the wedge shape.

The padded cushion 55 attached to the chest support 50 may also have a distinctive shape to improve the comfort of the patient. A cushion, being wedge shaped to have a thicker edge and an opposite thinner edge, may be disposed on the chest support with the thinner edge oriented either toward the patient's head or away from the patient's head, as required for the comfort of the patient and/or for support of the patient for treatment by the therapist. Preferably, the padded cushion 55 attached to the chest support is symmetrically shaped around the periphery. The chest support 55 may be connected across the arms of the first members 15 and may be viewed as the third cross member 27. When the chair 10 is adjusted from the most erect position to the least erect position, the uppermost portion of the chest support 50 is displaced through a vertical distance of approximately five to six inches. Also, when the chair 10 is so adjusted, the chest support 50 moves from a more vertical position to a more horizontal position which is angularly displaced at least 20° from the more vertical position.

The face support 53 is removably connected to the chair 10 and is further adjustable in a plane horizontal to the surface on which the chair is erected. Means are provided to secure the face support 53 in a desired attitude with respect to said horizontal plane. The face support 53 may be adjusted to be substantially adjacent to the frame of the chair 10 so that when the chair 10 is in the collapsed position, the face support 53 is in approximately the same plane as the frame and does not extend outwardly in a manner to interfere with the portability of the chair 10. A padded cushion 55 may be removably attached to the face support 53, preferably by hook and loop fasteners.

Figure 10:
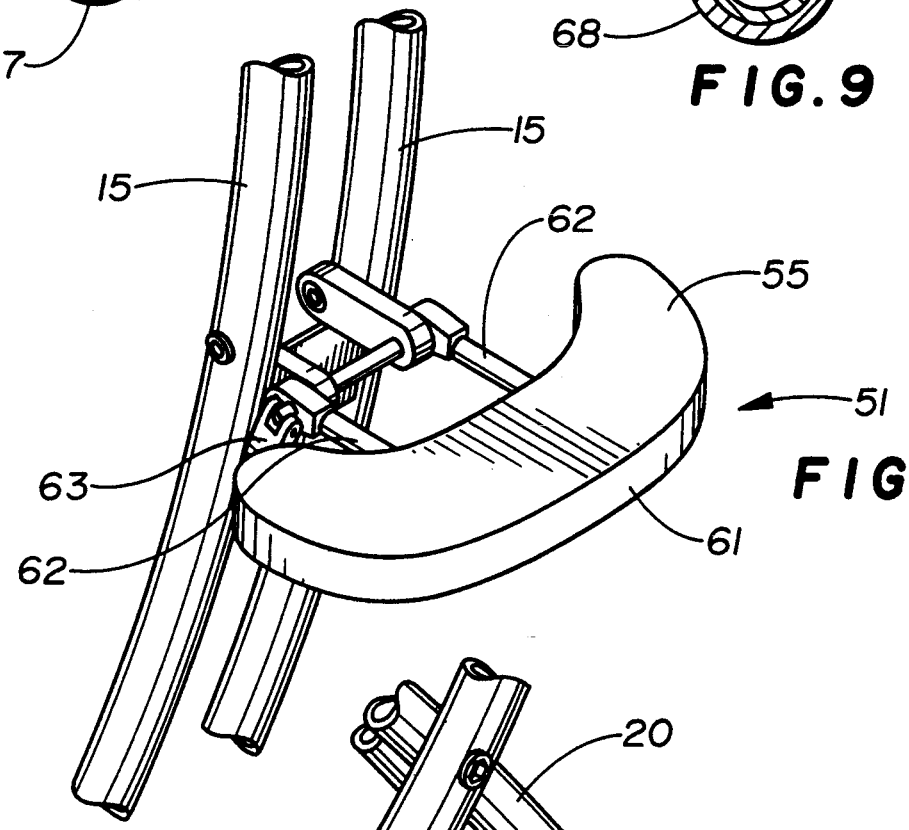
FIG. 10 is a perspective view of the arm support of the present invention.
Figure 11:
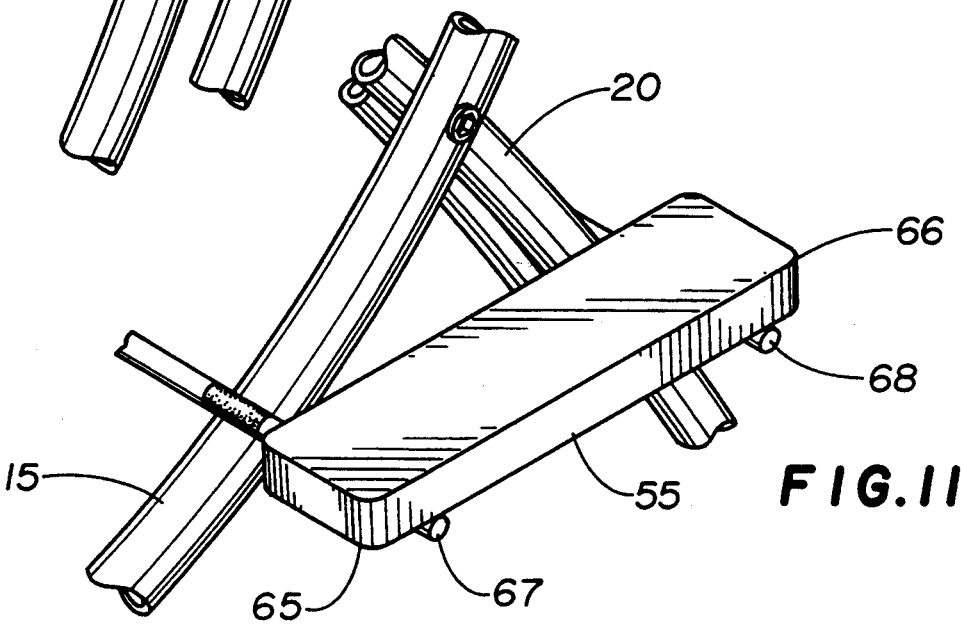
FIG. 11 is a perspective view of a leg support of the present invention.
Figure 10A:
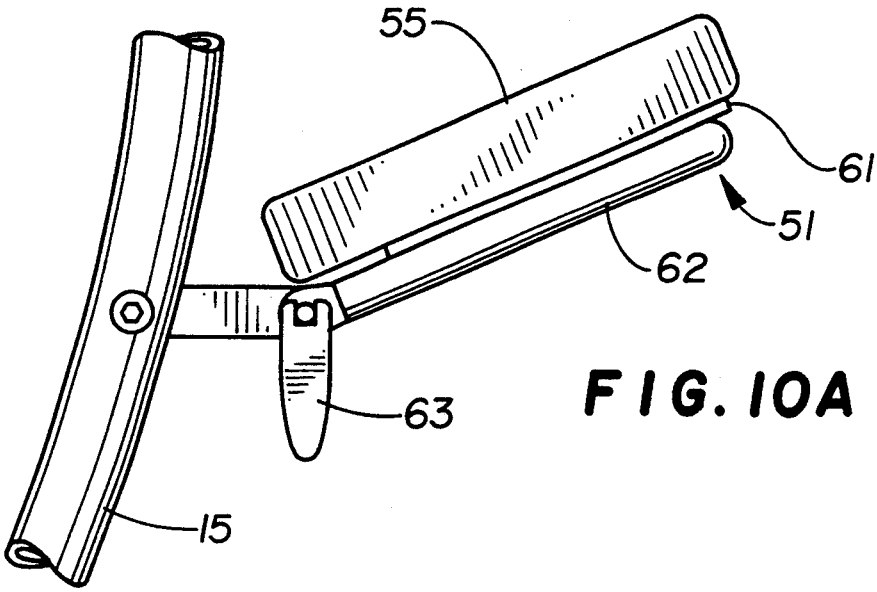
FIGS. 10A–10C are side views of a portion of the chair of the present invention showing positions of the arm support.
Figure 10B:
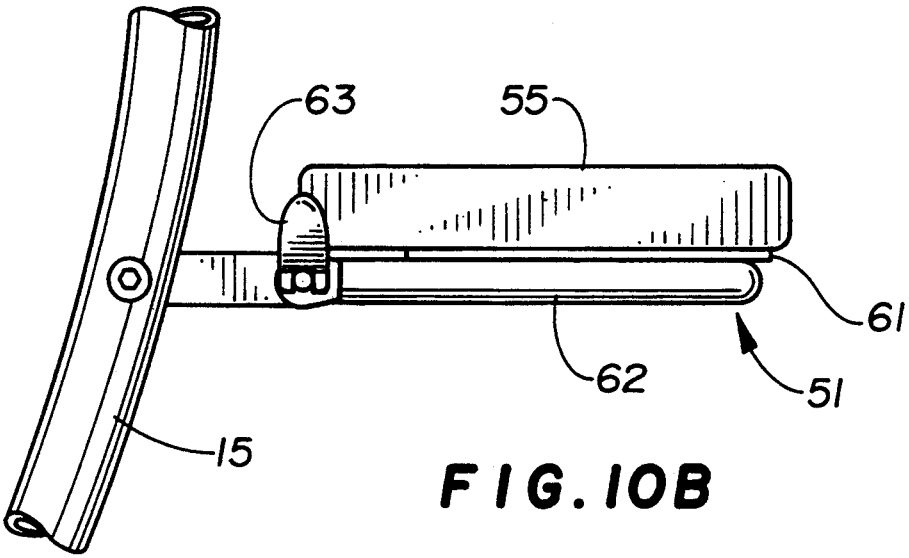
Figure 10C:
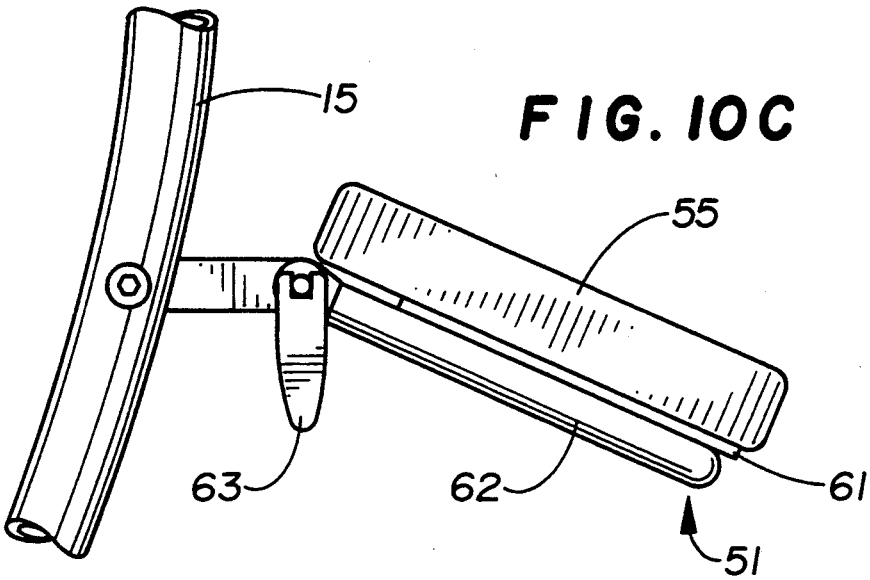

The arm support 51 is substantially C-shaped having a center 61 and two spaced apart arms 62 (FIGS. 8 and 10). The arm support preferably is a flat member but may be tubular or have other configurations. The arms 62 of the support are pivotably connected to the first members 15 (or sides) of the frame and means 63 are provided to control the pivotal movement between the arm support 51 and the sides of the frame. The control means 63 may be a cam type locking lever, a threaded knob or other means known to persons skilled in the art. It is preferred that the control means be easily and rapidly operated by one hand of the therapist. The arm support 51 is adjusted to the comfort of the patient and to a position most advantageous to the treatment administered by the therapist or the like. When the patient is seated on the chair 10, the patient is facing toward the back of the chair 10, and the patient's arms are on either side of the sides of the chair 10 and are supported on the arm support 51. Movement of the patient's arms away from the arm support 51 is undesirable for the treatment by the therapist. A padded cushion 55 is preferably C-shaped to correspond and mate with the C-shape of the arm support 51. The padded cushion 55 is removably attached to the arm support 51, preferably by hook and loop fasteners. Although the arm support 51 may be adjusted through approximately 180° of movement, FIGS. 10A–10C illustrate a typical range of adjustments for support of the arms of the patient.

Referring to FIGS. 6A and 6B, the leg supports 52 include a pair of supports, one on each side of the chair 10. Each leg support 52 has a front end 65 oriented toward the front of the chair 10 and a back end 66, oriented toward the back of the chair 10. The front ends 65 of the two leg supports 52 are connected by a first connecting member 67. The first connecting member 67 rests on the upper surface of the intermediate portions of the first members 15 of the frame. The back ends 66 of the two leg supports 52 are pivotably connected to a second connecting member 68 which extends between the leg supports 52 on either side of the chair. The second connecting member 68 is secured to the intermediate portions of the second members 20 of the frame in a manner wherein no movement of the second connecting member 68 is permitted. When the frame is moved in scissor-like manner, the first connecting member 67 slides along the upper surface of the first members 15 of the frame. When the frame is placed in the more erect position, the first connecting member 67 slides downwardly toward the bottom of the first member 15. When the frame is placed in a less erect position, the first connecting member 67 slides upwardly away from the bottom of the first member 67. The back ends 66 of the leg supports 52 pivot about the second connecting member to facilitate the sliding movement of the first connecting member 67. In this manner, when the chair is adjusted to an erect position to accommodate the patient, the disposition of leg supports 52 with respect to the seat 30, chest support 50, arm support 51, and face support 53 is also moved concomitantly. The chest support 50 is in a more vertical position when the chair 10 is in the most erect position. When the chair 10 is moved to the less erect position, the chest support 50 is disposed at an angle from the vertical position. In the least erect position, the bottom of the chest support is oriented outwardly from the back of the chair 10 at an angle of at least 20° from the more vertical position. Further the top of the chest support 50 moves vertically when the chair 10 is adjusted. In the most erect position, the top of the chest support 50 is approximately five to six inches above the horizontal plane of the top of the chest support 50 in the least erect position of the chair. When the chair 10 is folded to the collapsed position, the leg supports 52 are adjacent to, and substantially aligned with, the first member 15 and the second member 20 of the frame. Padded cushions 55 are provided for the leg supports 52 and are preferably removably attached with hook and loop fasteners. The shins and lower portion of the patient's legs are supported by the padded cushions 55. The removable cushions may be disposed on the leg supports 52 for the comfort of the patient.

In the completely folded, or collapsed, position, the chair 10 has a total length of approximately forty-four

(44) inches. The total weight of the chair 10, including all the padded cushions 55, the face support 53 and the arm support 51, is approximately eighteen (18) pounds. Thus, the chair 10 is readily portable by a single individual and can be moved within an office or taken to remote locations as needed.

Thus, the present invention discloses a unitary therapy chair which is entirely self-contained, having only removable padded cushions and which can be folded and/or set up without removal or addition of any components. The chair is portable and adjustable to meet the comfort of the patient and the positioning requirements of the therapist, and is completely collapsible for storage and transport. Support is provided for the seat, chest, face, arms and legs of the patient. The support points are all movable with respect to each other when the chair is adjusted. The pads are easily adjustable to be compatible with any size patient. The chair can be disposed in a plurality of positions and can be easily and rapidly secured into a desired position by the movement and engagement of a single cable. In the least erect position of the chair, the patient's back is disposed in a position which approaches the position of a patient on a therapy table enabling the therapist to provide treatment which otherwise would require a therapy table. The chair of the present invention is more accessible than a table to patients with mobility problems.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A unitary, portable and adjustable therapy chair on which a patient is seated to facilitate treatment by a therapist, the chair comprising:

a frame having a front, a back, a first side and a second side, each side further comprising a first member having a top, a bottom and an intermediate portion therebetween, and a second member having a top, a bottom and an intermediate portion therebetween, the intermediate portions of the respective members being pivotably connected such that the members may move in a scissors-like manner with respect to one another, the bottoms of the second members of each side being connected by a first cross member and the bottom of the first members on each side being connected by a second cross member, the first cross member and the second cross member being disposed on a horizontal surface when the patient is seated on the chair, the tops of the second members being connected to a seat, wherein when the frame is pivotably moved, both sides of the frame move concomitantly, and the frame is adjustable to a plurality of predetermined erected positions for seating the patient and to a collapsed position for storage and transport;

means for securing the frame in a desired use position;

a chest support connected to the frame between the first members, an arm support connected to the back of the frame, two separated leg supports connected to the frame, one leg support being on each side of the frame, and a face support adjustably connected to the tops of the first members of the frame;

wherein, when the frame is pivotably moved between the predetermined erected positions, the seat, the chest support, the arm support and the leg supports move with respect to one another and with respect to the horizontal surface on which the chair is supported to accommodate the posture and size of the patient seated on the chair and to reduce strain on the therapist treating the patient.

2. The chair of claim 1, further comprising the seat having a first edge and an opposite second edge, the first edge being pivotably connected between the top ends of the second members of the frame, the second edge of the seat being pivotably connected to a first end of a post, the post having a second end connected to a midpoint of the second cross member, thereby pivotably connecting the tops of the second members to the bottoms of the first members.

3. The chair of claim 1, wherein the frame is a tubular frame to reduce the weight of the chair.

4. The chair of claim 1, wherein the first cross member and the second cross member extend outwardly from the connection with the second members and the first members respectively, thereby providing improved lateral stability to the chair when the patient is seated on the chair.

5. The chair of claim 1, wherein padded cushions are removably attached to the seat, chest support, arm support, leg support and the face support for increased comfort of the patient.

6. The chair of claim 5, wherein the padded cushions of the chest support have a wedge shape.

7. The chair of claim 5, wherein hook and loop fastening means are attached to the padded cushions and to the seat, chest support, arm support, leg supports and face support for ease of attachment and removal of the padded cushions.

8. The chair of claim 1, wherein the chest support is connected on the front of the frame between the first members of each side of the frame and near the tops of said first members.

9. The chair of claim 1, wherein the arm support is substantially C shaped having a center and two spaced-apart arms, each arm being pivotably connected to the respective first member of each respective side, near the tops thereof, means for controlling pivotal movement between the arm support and the sides of the frame and means for securing the arm support in a desired position extending outwardly from the back of the frame so that the arm support may be adjusted for the comfort of the patient seated in the chair when the chair is erect and further so the arm support may be folded to a position adjacent to the respective first members of the sides of the frame when the chair is in the collapsed position.

10. The chair of claim 1 further comprising the leg supports each having a front end oriented toward the front of the chair and a back end oriented toward the back of the chair, the front ends of the respective leg supports being connected by a first connecting member, the first connecting member movably resting on the intermediate portion of the first members of the sides of the frame, the back ends of the respective leg supports being connected by a second connecting member, the second connecting member being secured to the intermediate portions of the second members of the sides of the frame, whereby, when the frame is moved in a scissor-like manner, the first connecting member slides along the intermediate portions of the first members of the sides of the frame and the leg supports move concomitantly to accommodate the patient seated in the chair, and the leg supports are adjacent to the first member of the frame when the chair is in the collapsed position.

11. The chair of claim 1, further comprising means for removably mounting the face support on the tops of the first members of the frame and means for adjustably orienting the face support at a desired angle with respect to the tops of the first members of the frame.

12. The chair of claim 1, wherein the chair is adjustable from a most erect position, through a plurality of intermediate positions, to a least erect position, the chair having an adjustable height which in the most erect position of the chair is approximately six inches greater than in the least erect position of the chair.

13. A unitary, portable and adjustable therapy chair on which a patient is seated to facilitate treatment by a therapist, the chair comprising:

a frame having a front, a back, a first side and a second side, each side further comprising a first member having a top, a bottom and an intermediate portion therebetween, and a second member having a top, a bottom and an intermediate portion therebetween, the intermediate portions of the respective members being pivotably connected such that the members may move in a scissors-like manner with respect to one another, the bottoms of the second members of each side being connected by a first cross member and the bottom of the first members on each side being connected by a second cross member, the first cross member and the second cross member being disposed on a horizontal surface when the patient is seated on the chair, the tops of the second members being connected to a seat, wherein when the frame is pivotably moved, both sides of the frame move concomitantly, and the frame is adjustable to a plurality of erected positions for seating the patient and to a collapsed position for storage and transport;

means for securing the frame in a desired use position;

a chest support connected to the frame, an arm support connected to the frame, two leg supports connected to the frame, and a face support connected to the tops of the first members of the frame;

wherein, when the frame is pivotably moved, the seat, the chest support, the arm support and the leg supports move with respect to one another and with respect to the horizontal surface on which the chair is supported to accommodate the posture and size of the patient seated on the chair and to reduce strain on the therapist treating the patient, the seat having a first edge and an opposite second edge, the first edge being pivotably connected between the top ends of the second members of the frame, the second edge of the seat being pivotably connected to a first end of a post, the post having a second end connected to a midpoint of the second cross member, thereby pivotably connecting the tops of the second members to the bottoms of the first members, the post having a plurality of spaced apart fastening means formed thereon, a cable having a first end connected to a midpoint of the first cross member, the cable extending beyond the second cross member, a second end of the cable having means thereon to removably engage at least one of the fastening means on the post such that when the second end of the cable and the fastening means on the post are engaged, the frame is secured in the desired use position and when the second end of the cable and the fastening means on the post are disengaged, the frame may be adjusted between the fully erected and the fully collapsed position.

14. The chair of claim 13, wherein an opening is formed near the second end of the post, the cable passing through the opening.

15. The chair of claim 13, wherein the fastening means on the post are a plurality of knobular protrusions extending outwardly from the post and the means on the second end of the cable to engage at least one of the knobular protrusions is a loop formed in the second end of the cable, wherein the loop on the cable may be engaged with a desired knobular protrusion, the frame being secured in the desired use position.

16. The chair of claim 13, wherein the fastening means on the post are a plurality of spaced apart openings on the post and the means on the secured end of the cable to engage at least one of the fastening means is a hook means formed on the second end of the cable, wherein the hook means on the cable may be received in a desired opening on the post, the frame being secured in the desired use position.

17. A unitary, portable, foldable and adjustable therapy chair on which a patient is seated to facilitate treatment by a therapist, the chair comprising:

a frame having a front, a back, a first side and a second side, each side further comprising a first member having a top, a bottom and an intermediate portion therebetween, and a second member having a top, a bottom and an intermediate portion therebetween, the intermediate portions of the respective members being pivotably connected such that the members may move in a scissors-like manner with respect to one another, the bottoms of the second members of each side being connected by a first cross member and the bottoms of the first members on each side being connected by a second cross member, the first cross member and the second cross member being disposed on a horizontal surface when the patient is seated on the chair, the tops of the first members being connected by a third cross member, the tops of the second members being connected by a fourth cross member, wherein when the frame is pivotably moved, both sides of the frame move concomitantly, and the frame is adjustable to a plurality of erected positions for seating the patient and to a collapsed position for storage and transport;

a seat having an upper surface, a first edge and an opposite second edge, said first edge being pivotably mounted to the fourth cross member, said second edge being pivotably connected to a first end of a post, the post having a second opposite end connected to a midpoint of the second cross member, whereby, when the chair is adjusted to seat the patient, the upper surface of the seat is movable from a horizontal plane substantially parallel to the surface on which the chair is disposed to a plane which is angled downwardly toward the back of the frame whereby the seat is adjusted for the comfort of the patient seated in the chair and whereby the seat is disposed adjacent to the first member of the sides when the chair is in the collapsed position;

means for securing the frame in a desired use position, the post having a plurality of spaced apart fastening means formed thereon, a cable having a first end connected to a midpoint of the first cross member, the cable extending beyond the second cross member, a second end of the cable having means thereon to removably engage at last one of the fastening means on the post such that when the second end of the cable and the fastening means on the post are engaged, the frame is secured in a desired use position, and when the second end of the cable and the fastening means on the end of the post are engaged, the frame may be adjusted between the fully erected and the fully collapsed position.

18. A unitary, portable, foldable and adjustable therapy chair on which a patient is seated to facilitate treatment by a therapist, the chair comprising:

a frame having a front, a back, a first side and a second side, each side further comprising a first member having a top, a bottom and an intermediate portion therebetween, and a second member having a top, a bottom and an intermediate portion therebetween, the intermediate portions of the respective members being pivotably connected such that the members may move in a scissors-like manner with respect to one another, the bottoms of the second members of each side being connected by a first cross member and the bottoms of the first members on each side being connected by a second cross member, the first cross member and the second cross member being disposed on a horizontal surface when the patient is seated on the chair, the tops of the first members being connected by a third cross member, the tops of the second members being connected by a fourth cross member wherein when the frame is pivotably moved, both sides of the frame move concomitantly, and the frame is adjustable to a plurality of erected positions for seating the patient and to a collapsed position for storage and transport;

a post having a first end and a second end, the first end of the post being pivotably connected to the fourth cross member, the second end of the post being connected to a midpoint of the second cross member, a plurality of spaced apart fastening means formed on the post, a cable having a first end connected to a midpoint of the first cross member, the cable extending beyond the second cross member, a second end of the cable having means thereon to removably engage at least one of the fastening means on the post such that when the second end of the cable and the fastening means on the post are engaged, the frame is secured in a desired use position, and when the second end of the cable and the fastening means on the end of the post are disengaged, the frame may be adjusted between the fully erected and the fully collapsed position.

19. A unitary, portable, foldable and adjustable therapy chair on which a patient is seated to facilitate treatment by a therapist, the chair comprising:

a tubular frame having a front, a back, a first side and a second side, each side further comprising a first member having a top, a bottom and an intermediate portion therebetween, and a second member having a top, a bottom and an intermediate portion therebetween, the intermediate portions of the respective members being pivotably connected such that the members may move in a scissor-like manner with respect to one another, the bottoms of the second members of each side being connected by a first cross member and the bottoms of the first members on each side being connected by a second cross member, the first cross member and the second cross member being disposed on a horizontal surface when the patient is seated on the chair, the top of the first members being connected by a third cross member, a seat having a first edge and an opposite second edge, the first edge being pivotably connected between the top ends of the second member of the frame, the second edge of the seat being pivotably connected to a first end of a post, the post having a second end connected to a midpoint of the second cross member, thereby pivotably connecting the tops of the second members to the bottoms of the first members, the post having a plurality of spaced-apart fastening means formed thereon, a cable having a first end connected to a midpoint of the first cross member, the cable extending beyond the second cross member, a second end of the cable having means thereon to removably engage at least one of the fastening means on the post such that when the second end of the cable and the fastening means on the post are engaged, the frame is secured in a desired use position and when the second end of the cable and the fastening means on the end of the post are disengaged, the frame may be adjusted between a fully erected and a fully collapsed position;

a chest support connected to the frame, an arm support connected to the frame, two leg supports connected to the frame and a face support connected to the tops of the first members of the frame;

wherein, when the frame is pivotably moved, both sides of the frame move concomitantly, the seat, the chest support, the arm support and the leg supports move with respect to one another to accommodate the posture and size of the patient seated on the chair and the frame is adjustable to a plurality of erected positions for seating the patient and to the collapsed position for storage and transport.

20. A unitary, portable, foldable and adjustable therapy chair on which a patient is seated to facilitate treatment by a therapist, the chair being disposable on a substantially horizontal surface, the chair comprising:

a frame having a front, a back, a first side, a second side, a first member and a second member, each member having a respective top, intermediate portion and bottom, the intermediate portions of each member being pivotably joined, wherein the first and second members may move in a scissors-like manner with respect to one another;

a seat having a first edge and a second opposite edge, the first edge of the seat being pivotably connected to the top of the second member of the frame, the seat being disposed on the front of the frame;

means for pivotably connecting the second edge of the seat to the bottom of the first member;

a chest support transversely mounted near the top of the first member and oriented toward the front of the frame;

an arm support adjustably mounted near the top of the first member and oriented toward the back of the frame;

a face support adjustably mounted on the top of the first member of the frame;

a pair of leg supports, one leg support mounted on each respective side of the frame;

and means for securing the frame in a desired use position;

wherein the chair may be pivotably folded from a collapsed position to a plurality of predetermined erect desired use positions, and when so folded, the seat, the chest support, the arm support and the leg supports move with respect to one another and with respect to the horizontal surface on which the chair is disposed whereby the posture and size of the patient is accommodated and strain is reduced on the therapist or the like treating the patient.

21. The chair of claim 20, further comprising the first member of the frame including a pair of spaced-apart arms each having a respective top, bottom and intermediate portion therebetween, the second member of the frame including a pair of spaced-apart arms each having a respective top, bottom and intermediate position therebetween, the intermediate portions of the arms of the first member being connected to the intermediate portions of the arms of the second member for pivotal, scissors-like movement between the first and second members.

22. The chair of claim 21, wherein the arms are tubular to reduce the weight of the chair.

23. The chair of claim 20, wherein the first member of the frame is arcuate being concave with respect to the horizontal surface on which the chair is disposed, the second member of the frame is arcuate, being convex with respect to the horizontal surface on which the chair is disposed, each member of the frame having a respective length, the length of the first member of the frame being greater than the length of the second member of the frame.

24. The chair of claim 20, further comprising:

a post having a first end and a second opposite end, the first end of the post being pivotably connected to the second end of the seat, the second end of the post being pivotably connected to the bottom of the first member.

25. The chair of claim 20, wherein padded cushions are removably attached to the seat, chest support, arm support, leg supports and face support for increased comfort of the patient.

26. The chair of claim 25, wherein hook and loop fastening means are attached to the padded cushions and to the seat, chest support, arm support, leg supports, and face support for ease of attachment and removal of the padded cushions.

27. The chair of claim 20, wherein the seat has an upper surface, whereby when the chair is adjusted in the desired use position to seat the patient, the upper surface of the seat is movable from a horizontal plane substantially parallel to the surface on which the chair is disposed to a plane which is angled downwardly toward the back of the frame whereby the seat is adjusted for the comfort of the patient seated in the chair and whereby the seat is disposed adjacent to the first members of the sides when the chair is in the collapsed position.

28. The chair of claim 27, wherein the plane of the upper surface of the seat of the chair may be angled to at least 45° from the horizontal plane.

29. The chair of claim 20, further comprising the leg supports each having a front end oriented toward the front of the chair and a back end oriented toward the back of the chair, the front ends of the respective leg supports being connected by a first connecting member, the first connecting member movably resting on the intermediate portion of the first member of the frame, the back ends of the respective leg supports being pivotably connected to a second connecting member, the second connecting member extending between the back ends of the leg supports, the second connecting member being secured to the intermediate portion of the second member of the frame, whereby, when the frame is moved in a scissor-like manner, the first connecting member slides along the intermediate portion of the first member of the frame and the leg supports move concomitantly to accommodate the patient seated on the chair and the leg supports are adjacent to the first member of the frame when the chair is in the collapsed position.

30. The chair of claim 20, further comprising the arm support being substantially C-shaped having a center and two spaced-apart arms, each arm being pivotably connected to the respective first member of each respective side, near the tops thereof, means for controlling pivotal movement between the arm support and the sides of the frame and means for securing the arm support in a desired position extending outward from the back of the frame so that the arm support may be adjusted for the comfort of the patient seated in the chair when the chair is erect and further so the arm support may be folded to a position adjacent to the respective first members of the sides of the frame when the chair is in the collapsed position.

31. A unitary, portable, foldable and adjustable therapy chair on which a patient is seated to facilitate treatment by a therapist, the chair being disposable on a substantially horizontal surface, the chair comprising:

a frame having a front, a back, a first side, a second side, a first member and a second member, each member having a respective top, intermediate portion and bottom, the intermediate portions of each member being pivotably joined, wherein the first and second members may move in a scissors-like manner with respect to one another;

a seat having a first edge and a second opposite edge, the first edge of the seat being pivotably connected to the top of the second member of the frame, the seat being disposed on the front of the frame;

means for pivotably connecting the second edge of the seat to the bottom of the first member;

chest support mounted near the top of the first member and oriented toward the front of the frame;

an arm support adjustably mounted near the top of the first member and oriented toward the back of the frame;

a face support adjustably mounted on the top of the first member of the frame;

a pair of leg supports, one leg support mounted on each respective side of the frame;

and means for securing the frame in a desired use position;

wherein the chair may be pivotably folded from a collapsed position to a plurality of erect positions, and when so folded, the seat, the chest support, the arm support and the leg supports move with respect to one another and with respect to the horizontal surface on which the chair is disposed whereby the posture and size of the patient is accommodated and strain is reduced on the therapist treating the patient, a post having a first end and a second opposite end, the first end of the post being pivotably connected to the second end of the seat, the second end of the post being pivotably connected to the bottom of the first member, the post having a plurality of fastening means formed thereon, a cable having a first end and a second end, the first end of the cable being connected to the bottom of the second member, the cable extending toward the front of the chair beyond the bottom of the first member, the second end of the cable having means thereon to removably engage at least one of the fastening means on the post such that when the second end of the cable and the fastening means on the post are engaged, the frame is secured in the desired use position and when the second end of the cable and the fastening means on the post are disengaged, the frame may be adjusted between a fully erected and a fully collapsed position.

* * * * *